US011369991B2

(12) United States Patent
Omura

(10) Patent No.: US 11,369,991 B2
(45) Date of Patent: Jun. 28, 2022

(54) METHOD FOR FORMING MULTILAYER COATING FILM

(71) Applicant: KANSAI PAINT CO., LTD., Hyogo (JP)

(72) Inventor: Masahiro Omura, Aichi (JP)

(73) Assignee: KANSAI PAINT CO., LTD., Hyogo (JP)

( * ) Notice: Subject to any disclaimer, the term of this patent is extended or adjusted under 35 U.S.C. 154(b) by 0 days.

(21) Appl. No.: 17/057,138

(22) PCT Filed: May 20, 2019

(86) PCT No.: PCT/JP2019/019977

§ 371 (c)(1),
(2) Date: Nov. 20, 2020

(87) PCT Pub. No.: WO2019/225559

PCT Pub. Date: Nov. 28, 2019

(65) Prior Publication Data

US 2021/0121914 A1 Apr. 29, 2021

(30) Foreign Application Priority Data

May 23, 2018 (JP) ..... JP2018-099211

(51) Int. Cl.

| | |
|---|---|
| ***B05D 7/00*** | (2006.01) |
| ***B05D 5/06*** | (2006.01) |
| ***B05D 7/14*** | (2006.01) |

(52) U.S. Cl.

CPC ..... *B05D 7/5723* (2013.01); *B05D 5/06* (2013.01); *B05D 7/142* (2013.01); *B05D 7/577* (2013.01); *B05D 2202/10* (2013.01); *B05D 2252/00* (2013.01); *B05D 2350/60* (2013.01); *B05D 2401/20* (2013.01); *B05D 2420/05* (2013.01); *B05D 2601/24* (2013.01)

(58) Field of Classification Search

None

See application file for complete search history.

(56) References Cited

U.S. PATENT DOCUMENTS

| | | | |
|---|---|---|---|
| 5,718,950 | A | 2/1998 | Komatsu et al. |
| 2016/0200922 | A1 | 7/2016 | Sugamoto et al. |
| 2017/0252776 | A1 | 9/2017 | Nakata et al. |

FOREIGN PATENT DOCUMENTS

| | | | |
|---|---|---|---|
| JP | 8-164358 | A | 6/1996 |
| JP | 2004-351391 | A | 12/2004 |
| JP | 2012-125747 | A | 7/2012 |
| JP | 2012-157827 | A | 8/2012 |
| JP | 2016-221473 | A | 12/2016 |
| JP | 2017-154089 | A | 9/2017 |
| WO | 2004/105965 | A1 | 12/2004 |
| WO | 2011/125490 | A1 | 10/2011 |
| WO | 2012/080792 | A1 | 6/2012 |
| WO | 2018/034278 | A1 | 2/2018 |

OTHER PUBLICATIONS

International Search Report dated Jul. 30, 2019 issued in corresponding PCT/JP2019/019977 application (1 page).

Search Report dated Feb. 3, 2022 in corresponding European Patent Application No. 19808001.2 (pp. 1-4).

*Primary Examiner* — Shamim Ahmed

*Assistant Examiner* — Bradford M Gates

(74) *Attorney, Agent, or Firm* — Millen, White, Zelano and Branigan, P.C.; Harry B. Shubin

(57) ABSTRACT

Provided is a method for forming a multilayer coating film, the method being capable of forming a high-brightness white multilayer coating film which is excellent in terms of brilliant feeling, smoothness, and weather resistance and with which white stains are suppressed. In this method for forming a multilayer coating film to form a brilliant coating film, a white multilayer coating film is formed by: sequentially applying a first coloring paint (P1), a second aqueous coloring paint (P2), a third aqueous coloring paint (P3), and a clear coat paint (P4) on a cured electrodeposition coating film formed on a steel sheet; and forming a first colored coating film, a second colored coating film, a third colored coating film, and a clear coat coating film which each have a particular composition, brightness, film thickness, and the like.

8 Claims, No Drawings

METHOD FOR FORMING MULTILAYER COATING FILM

FIELD

The present invention relates to a multilayer coating film-forming method, and especially to a multilayer coating film-forming method that can form a white multilayer coating film having high lightness and excellent sheen quality, smoothness and weather resistance, as well as reduced unevenness of whiteness.

BACKGROUND

It is well known in the prior art to form white multilayer coating films comprising electrodeposition coating films, intercoating films, white base coating films, white pearl effect or silver pearl effect brightness base coating films, and clear coating films, on coated articles such as automobile external platings (PTL 1, for example).

When such white multilayer coating films are formed, light rays pass through the clear coating film and brightness base coating film, so that the color tone of the white base coating film combined with the design property of the brightness base coating film exhibits a high-quality outer appearance with an excellent sheen quality by means of a white pearl effect or silver pearl effect.

In recent years there has been increasing demand for white base coating films with high lightness, in order to obtain white multilayer coating films of higher-quality texture.

One method for forming a white base coating film with high lightness is to lower the content of color pigments other than white pigments in the white base coat material, but this has tended to increase the light transmittance of the resulting white base coating film, thereby lowering the hiding power of the base layer color, and consequently lowering the weather resistance of the white multilayer coating film and creating a greater likelihood of unevenness of whiteness.

PTL 1 describes using, as a white base coat material, a colored base coating that forms a coating film adjusted to the range of N7-N9 on the Munsell color chart by a titanium white pigment and aluminum flakes, allowing formation of a multilayer coating film that is superior in terms of high-whiteness, pearlescent feel and a stable tint. However, the lightness of white base coating films formed by this method has been insufficient.

Smoothness is generally desired for coating films, but in recent years, there has been increasing demand for coating materials to exhibit aqueous properties, from the viewpoint of reducing environmental pollution caused by organic solvents, and the result has been that such aqueous coating materials often lower the smoothness of formed coating films due to the low volatilization rate of water that is used as the diluting solvent, and the fact that the volatilization rate is significantly affected by environmental conditions during application such as temperature and humidity.

CITATION LIST

Patent Literature

[PTL 1] JP H08-164358 A

SUMMARY

Technical Problem

It is an object of the present invention to meet the demands mentioned above by providing a multilayer coating film-forming method that can form a high-lightness white multilayer coating film with excellent sheen quality, smoothness and weather resistance and low unevenness of whiteness, when an aqueous white base coat material, aqueous brightness base coat material and clear coating material are applied in that order onto an article to be coated.

Solution to Problem

The present inventors have completed this invention upon finding that the aforementioned object can be achieved by a multilayer coating film-forming method for formation of a white multilayer coating film, wherein a specific first pigmented coating material (P1), second aqueous pigmented coating material (P2), third aqueous pigmented coating material (P3) and clear coating material (P4) are applied onto a cured electrodeposition coating film formed on a steel sheet, to form a first pigmented coating film, second pigmented coating film, third pigmented coating film and clear coating film having specific compositions and lightness, while the multilayer coating film comprising at least the second pigmented coating film, third pigmented coating film and clear coating film is heated and simultaneously cured.

Specifically, the invention relates to a multilayer coating film-forming method comprising the following steps (1) to (6):

(1) a step of applying an electrodeposition coating material onto a steel sheet and heat curing it to form a cured electrodeposition coating film, (2) a step of applying a first pigmented coating material (P1) onto the cured electrodeposition coating film obtained in step (1) to form a first pigmented coating film, the first pigmented coating material (P1) having a lightness L* value ($L^*_{P1}$) in the range of 80 to 89 when the cured coating film is formed to a thickness of 30 μm, (3) a step of applying a second aqueous pigmented coating material (P2) comprising a binder component ($A_{P2}$) and a titanium dioxide pigment (B) and having a coating material solid content in the range of 21 to 50 mass % onto the first pigmented coating film obtained in step (2), to form a second pigmented coating film having a cured film thickness ($T_{P2}$) in the range of 5 to 20 μm and a lightness L* value ($L^*_{P2}$) when cured, in the range of 85 to 95, (4) a step of applying a third aqueous pigmented coating material (P3) onto the second pigmented coating film obtained in step (3) to form a third pigmented coating film having a cured film thickness ($T_{P3}$) in the range of 1 to 10 μm, the third aqueous pigmented coating material (P3) comprising a binder component ($A_{P3}$) and a light interference pigment (C) and having a coating material solid content in the range of 5 to 20 mass %, (5) a step of applying a clear coating material (P4) onto the third pigmented coating film obtained in step (4) to form a clear coating film, and (6) a step of heating the multilayer coating film including the first pigmented coating film, the second pigmented coating film, the third pigmented coating film and the clear coating film formed in steps (2) to (5), to simultaneously cure the multilayer coating film, wherein $L^*_{P2}$ is higher than $L^*_{P1}$, the difference between $L^*_{P2}$ and $L^*_{P1}$ is in the range of 1 to 10, and the ratio of $T_{P2}$ and $T_{P3}$ is in the range of $T_{P2}/T_{P3}$=1.1/1 to 20/1.

Advantageous Effects of Invention

Using the method of the invention it is possible to form a high-lightness white multilayer coating film having excellent sheen quality, smoothness and weather resistance, and reduced unevenness of whiteness.

DESCRIPTION OF EMBODIMENTS

Modes for carrying out the invention will now be explained in detail.

[Formation of Cured Electrodeposition Coating Film]

According to the invention, first an electrodeposition coating material is applied onto a steel sheet and heat cured to form a cured electrodeposition coating film (step (1)). For the purpose of the present specification, an "electrodeposition coating material" is a coating material that is used by being applied onto the surface of a steel sheet as the article to be coated, to prevent rust and corrosion of the steel sheet while also reinforcing the impact resistance of the surface of the article on which the multilayer coating film has been formed.

The steel sheet used as the article to be coated may be, for example, a cold-rolled steel sheet, an alloyed molten galvanized steel sheet, an electrolytic galvanized steel sheet, an electrolytic zinc-iron bilayer plated steel sheet, an organic composite plated steel sheet, an Al material or a Mg material. Such metal sheets that have been surface-treated by phosphate chemical conversion, chromate treatment or complex oxide treatment after surface cleaning by alkali degreasing as necessary, may also be used.

The electrodeposition coating material to be used in this step is preferably a thermosetting aqueous coating material commonly employed in the technical field, and any cationic electrodeposition coating material or anionic electrodeposition coating material may be used. Such an electrodeposition coating material is preferably an aqueous coating material comprising a base resin and a curing agent, as well as an aqueous medium composed of water and/or a hydrophilic organic solvent.

From the viewpoint of rust resistance, the base resin is preferably an epoxy resin, acrylic resin or polyester resin, for example. Preferred among these from the viewpoint of rust resistance are resins with aromatic rings, for at least one type of base resin, with aromatic ring-containing epoxy resins being more preferred. Examples of curing agents to be used include blocked polyisocyanate compounds and amino resins. Examples of hydrophilic organic solvents include methanol, ethanol, n-propyl alcohol, isopropyl alcohol and ethylene glycol. Application of the electrodeposition coating material allows a highly rust-resistant coating film to be obtained.

The means used to apply the electrodeposition coating material onto the steel sheet in this step may be an electrodeposition method commonly employed in the technical field. Such a coating method can produce a coating film with high rust resistance over essentially the entire surface, even for pre-molded articles that are to be coated.

In order to prevent formation of a mixed layer between the electrodeposition coating film formed in this step and the first pigmented coating film formed on the electrodeposition coating film, and to increase the outer appearance of the multilayer coating film that is obtained as a result, the uncured electrodeposition coating film is subjected to baking treatment for heat curing after the thermosetting electrodeposition coating material has been applied. As used herein, "cured electrodeposition coating film" means a coating film obtained by heat curing of an electrodeposition coating film that has been formed on a steel sheet.

Baking treatment at temperatures above 190° C. is generally undesirable because it causes the coating film to become too hard and fragile, while baking treatment at temperatures below 110° C. is undesirable because reaction between the components is insufficient. In this step, therefore, the temperature for baking treatment of the uncured electrodeposition coating film is generally preferred to be in the range of 110 to 190° C. and especially 120 to 180° C. The baking treatment time is usually preferred to be 10 to 60 minutes. Baking treatment under such conditions can yield an electrodeposition coating film in a cured dry state.

The dry film thickness of the cured electrodeposition coating film after baking treatment under these conditions is usually preferred to be in the range of 5 to 40 μm and especially 10 to m.

Forming an electrodeposition coating film in this manner can improve the rust resistance of the coated steel.

[Formation of First Pigmented Coating Film]

The first pigmented coating material (P1) is applied onto the cured electrodeposition coating film obtained in step (1), forming the first pigmented coating film (step (2)). The first pigmented coating material (P1) is a coating material comprising a binder component and a color pigment, the L* value ($L^*_{P1}$), as the lightness in the L*a*b* color system, being in the range of 80 to 89 when the cured coating film has been formed to a thickness of 30 μm. Forming the first pigmented coating film using the first pigmented coating material (P1) can yield a high-lightness white multilayer coating film with excellent weather resistance and reduced unevenness of whiteness. Excellent weather resistance is, more specifically, resistance to lowering of adhesive force between the multilayer coating film and the underlying electrodeposition coating film after prolonged outdoor exposure. One possible reason for the excellent weather resistance of the coating film formed according to the invention is believed to be that the first pigmented coating film blocks a relatively large amount of sunlight rays, which are a cause of degradation of the underlying electrodeposition coating film.

The L*a*b* color system is the color system standardized by the Commission Internationale de l'Eclairage (CIE) in 1976, and also adopted in Japan as JIS Z 8784-1, and it expresses lightness as L*, and chromaticity (hue and chroma) as a* and b*. The value of a* represents the red direction (−a* being the green direction), and b* represents the yellow direction (−b* being the blue direction). The values of L*, a* and b*, as used herein, are defined as the numerical values calculated from the spectral reflectance received at 900 with respect to the coating film surface, using a multi-angle spectrophotometer CM512m3 (trade name of Konica Minolta Holdings, Inc.), with light irradiation at 45° with respect to the axis perpendicular to the coating film surface.

As mentioned above, the first pigmented coating material (P1) of the invention is adjusted to a pigment content such that the lightness L* value ($L^*_{P1}$) of the obtained coating film is in the range of 80 to 89, when applied as a 30 μm cured coating film. Adjustment of the lightness L* value ($L^*_{P1}$) of the first pigmented coating film to within a suitable range allows formation of a white multilayer coating film with sufficient weather resistance and reduced unevenness of whiteness, in combination with the second pigmented coating film described below. The lightness L* value ($L^*_{P1}$) is more preferably in the range of 83 to 89 and even more preferably in the range of 85 to 89. In relation to the lightness L* value ($L^*_{P2}$) during curing of the second pigmented coating film formed by the second aqueous pigmented coating material described below, the $L^*_{P1}$ value is adjusted so that $L^*_{P2}$ is higher than $L^*_{P1}$, and the difference between $L^*_{P2}$ and $L^*_{P1}$ is in the range of 1 to 10. By adjusting the difference between $L^*_{P2}$ and $L^*_{P1}$, it is possible to more effectively reduce unevenness of whiteness in the white multilayer coating film that is formed. The difference between $L^*_{P2}$ and $L^*_{P1}$ is more preferably in the range of 2 to 9 and even more preferably in the range of 3 to 8.

The color pigment used in the first pigmented coating material (P1) is not especially restricted so long as it allows the L* value ($L^*_{P1}$) to be adjusted to the range of 80 to 89, and any color pigment known in the prior art may be used. Specific examples include one or combinations of more than one among complex metal oxide pigments such as the titanium dioxide pigment (B) described below, iron oxide pigments and titanium yellow, azo-based pigments, quinacridone-based pigments, diketopyrrolopyrrole-based pigments, perylene-based pigments, perinone-based pigments, benzimidazolone-based pigments, isoindoline-based pigments, isoindolinone-based pigments, metal chelate azo-based pigments, phthalocyanine-based pigments, indanthrone-based pigments, dioxane-based pigments, threne-based pigments, indigo-based pigments and carbon black pigments.

Preferably, at least one of the color pigments used in the first pigmented coating material (P1) is titanium dioxide pigment (B), from the viewpoint of weather resistance of the white multilayer coating film that is formed. When the first pigmented coating material (P1) contains titanium dioxide pigment (B), the content of the titanium dioxide pigment (B) is suitably in the range of 60 to 150 parts by mass, preferably 75 to 130 parts by mass and more preferably 90 to 110 parts by mass, based on 100 parts by mass as the total solid content of the binder component in the first pigmented coating material (P1).

Preferably, at least one of the color pigments used in the first pigmented coating material (P1) is a carbon black pigment, from the viewpoint of weather resistance of the white multilayer coating film that is formed. When the first pigmented coating material (P1) contains a carbon black pigment, the content of the carbon black pigment is suitably in the range of 0.01 to 0.50 part by mass, preferably 0.02 to 0.30 part by mass and more preferably 0.03 to 0.20 part by mass, based on 100 parts by mass as the total solid content of the binder component in the first pigmented coating material (P1).

The binder component used in the first pigmented coating material (P1) may be a coating film-forming resin composition commonly used in intercoat materials. Examples of such resin compositions include those having both a base resin such as an acrylic resin, polyester resin, alkyd resin or urethane resin with crosslinkable functional groups such as hydroxyl groups, and a crosslinking agent such as a melamine resin, urea resin or polyisocyanate compound (including a blocked type), which may be used in a form dissolved or dispersed in a solvent such as an organic solvent and/or water.

According to the invention, the first pigmented coating material (P1) may include suitable additives as necessary, including solvents such as water or organic solvents, pigment dispersants, curing catalysts, antifoaming agents, antioxidants, ultraviolet absorbers, light stabilizers, thickening agents or surface control agents, or brightness pigments such as aluminum pigments, and extender pigments such as barium sulfate, barium carbonate, calcium carbonate, talc or silica.

The first pigmented coating material (P1) may be either an aqueous coating material or an organic solvent-based coating material, but it is preferably an aqueous coating material from the viewpoint of VOC reduction. An aqueous coating material is a term used in contrast to "organic solvent-based coating material", and generally refers to a coating material having a binder component, pigment and the like dispersed and/or dissolved in water or a medium composed mainly of water (an aqueous medium). When the first pigmented coating material (P1) is an aqueous coating material, the content of water in the first pigmented coating material (P1) is preferably about 20 to 80 mass % and more preferably about 30 to 60 mass %.

The first pigmented coating material (P1) can be prepared by mixing and dispersing the components mentioned above. The solid coating material content of the first pigmented coating material (P1) is preferably adjusted to be in the range of 30 to 60 mass % and more preferably 40 to 50 mass %.

The first pigmented coating material (P1) can be applied by adding water or an organic solvent for adjustment to a viscosity suitable for coating, and then application as necessary by a method such as rotary atomizing coating, air spraying or airless spraying, and from the viewpoint of smoothness and finished appearance of the coating film, the film thickness is in the range of preferably 15 to 40 μm, more preferably 17 to 35 μm and even more preferably 20 to 30 μm, based on the cured coating film ($T_{P1}$).

According to the invention, from the viewpoint of improved weather resistance, the first pigmented coating material (P1) preferably has a mean light transmittance ($TR_{P1}$) in the range of 0.08% or lower at a wavelength of 360 to 420 nm, for the cured coating film that is obtained by application to a cured coating film thickness of 30 μm. The mean light transmittance ($TR_{P1}$) at a wavelength of 360 to 420 nm is more preferably 0.07% or lower and even more preferably 0.06% or lower. The mean light transmittance ($TR_{P1}$) can be set by adjusting the thickness of the cured coating film and the amount of pigment in the coating material, for example.

The mean light transmittance ($TR_{P1}$) of the 30 μm-thick cured coating film at a wavelength of 360 to 420 nm can be measured by the following method. First, the first pigmented coating material (P1) is applied and cured on a polytetrafluoroethylene sheet, to a cured coating film thickness of 30 μm. The coating film obtained by curing is then detached and collected, and a spectrophotometer is used to measure the mean light transmittance in the wavelength range of 360 to 420 nm. The spectrophotometer used may be a "SolidSpec-3700" (trade name of Shimadzu Corp.).

The first pigmented coating film may be provided in its uncured state for formation of the second pigmented coating film in the following step (3), or it may be cured by heating before application of the second aqueous pigmented coating material. Providing the first pigmented coating film to step (3) in its uncured state is advantageous in terms of energy savings, since in the subsequent step (6) it can be heat cured together with the second pigmented coating film, third pigmented coating film and clear coating film that are formed in steps (3) to (5). When the first pigmented coating film is heat cured before application of the second aqueous pigmented coating material, this allows the smoothness of the coating film to be further increased by polishing by means such as wet grinding of the cured first pigmented coating film surface. The heating means for heat curing may be hot air heating, infrared heating or high-frequency heating, for example. The heating temperature is preferably 80 to 180° C. and more preferably 100 to 160° C. The heating time is preferably 10 to 60 minutes and more preferably 15 to 40 minutes. If necessary, the heat curing may be preceded by direct or indirect heating, via preheating or air blowing before heat curing, at a temperature of about 50° C. to about 110° C. and preferably about 60° C. to about 90° C., for about 1 to 60 minutes.

[Formation of Second Pigmented Coating Film]

In step (3), the second aqueous pigmented coating material (P2) is applied as an aqueous coating material onto the first pigmented coating film obtained in step (2), to form a second pigmented coating film with a cured film thickness ($T_{P2}$) in the range of 5 to 20 μm, and a lightness L* value ($L^*_{P2}$) in the range of 85 to 95 when cured. The lightness L* value ($L^*_{P2}$) of the second pigmented coating film when cured is the lightness obtained with both the first pigmented coating film and second pigmented coating film cured in layered form, with measurement from the surface on the opposite side of the second pigmented coating film from the side in contact with the first pigmented coating film. The second aqueous pigmented coating material (P2) contains a binder component ($A_{P2}$) and a titanium dioxide pigment (B), with a coating material solid content in the range of 21 to 50 mass %. As mentioned above, in relation to the lightness L* value ($L^*_{P1}$) when a 30 μm-thick cured coating film has been formed using the first pigmented coating material, the lightness $L^*_{P2}$ value is adjusted so that $L^*_{P2}$ is higher than $L^*_{P1}$, and the difference between $L^*_{P2}$ and $L^*_{P1}$ is in the range of 1 to 10. In relation to the cured film thickness $T_{P3}$ of the third pigmented coating film described below, the cured film thickness $T_{P2}$ is adjusted so that $T_{P2}/T_{P3}$ is in the range of 1.1/1 to 20/1. By using the second aqueous pigmented coating material (P2) to form the second pigmented coating film, it is possible to form a coating film with high lightness while also having excellent sheen quality and weather resistance and reduced unevenness of whiteness, in combination with the first pigmented coating film and third pigmented coating film that are formed above and below it.

The binder component ($A_{P2}$) used in the second aqueous pigmented coating material (P2) may be a resin composition comprising a coating film-forming resin commonly used in coating materials. A thermosetting resin composition can be suitably used as such a resin composition, and specific examples include those having both a base resin such as an acrylic resin, polyester resin, alkyd resin or urethane resin with crosslinkable functional groups such as hydroxyl groups, and a crosslinking agent such as a melamine resin, urea resin or polyisocyanate compound (including a blocked type). Such resin compositions may be used by dissolution or dispersion in a solvent such as an organic solvent and/or water. The proportion of the base resin and crosslinking agent in the resin composition is not particularly restricted, but usually the crosslinking agent may be used in the range of 10 to 100 mass %, preferably 20 to 80 mass % and more preferably 30 to 60 mass % with respect to the total amount of the base resin solid content.

The titanium dioxide pigment (B) used in the second aqueous pigmented coating material (P2) is a white pigment that is able to impart white color to the formed coating film. The crystal form of the titanium dioxide pigment (B) may be either rutile or anatase, but it is preferably rutile from the viewpoint of superior hiding power and weather resistance of the coating film that is formed. The titanium dioxide pigment (B) may also be titanium dioxide having the surface coated with an inorganic oxide such as aluminum oxide, zirconium oxide or silicon dioxide; or with an organic compound such as an amine or alcohol.

The titanium dioxide pigment (B) content is adjusted so that the lightness L* value ($L^*_{P2}$) is in the range of 85 to 95 during curing of the second pigmented coating film formed using the second aqueous pigmented coating material (P2), and for most cases the titanium dioxide pigment (B) is preferably in the range of 60 to 150 parts by mass, more preferably in the range of 65 to 125 parts by mass and even more preferably in the range of 70 to 100 parts by mass, with respect to 100 parts by solid mass of the binder component ($A_{P2}$).

The lightness L* value ($L^*_{P2}$) is more preferably in the range of 87 to 95 and even more preferably in the range of 89 to 95, from the viewpoint of ensuring high lightness without loss of weather resistance, in combination with the first pigmented coating film. Furthermore, as mentioned above, in relation to the lightness L* value ($L^*_{P1}$) when a 30 μm-thick cured coating film has been formed using the first pigmented coating material, the $L^*_{P2}$ value is adjusted so that $L^*_{P2}$ is higher than $L^*_{P1}$, and the difference between $L^*_{P2}$ and $L^*_{P1}$ is in the range of 1 to 10.

The second aqueous pigmented coating material (P2) may further include suitable additives as necessary, including pigment dispersants, curing catalysts, antifoaming agents, antioxidants, ultraviolet absorbers, light stabilizers, thickening agents or surface control agents, or brightness pigments such as aluminum pigments, and extender pigments such as barium sulfate, barium carbonate, calcium carbonate, talc or silica.

The second aqueous pigmented coating material (P2) may be applied by a known coating method such as electrostatic coating, air spraying or airless spraying.

The solid content of the second aqueous pigmented coating material (P2) is suitably in the range of 21 to 50 mass %, preferably in the range of 22 to 40 mass % and more preferably in the range of 24 to 35 mass %.

The thickness of the second pigmented coating film formed by the second aqueous pigmented coating material (P2) is suitably in the range of 5 to 20 μm, preferably in the range of 6 to 16 μm and more preferably in the range of 7 to 14 μm, as the cured film thickness ($T_{P2}$).

By adjusting the solid content of the second aqueous pigmented coating material (P2) to within the aforementioned range while also adjusting the thickness of the second pigmented coating film formed by the second aqueous coating material (P2) to within a certain range, it is possible to form a multilayer coating film with reduced unevenness of whiteness and sufficient smoothness.

In relation to the cured film thickness $T_{P3}$ of the third pigmented coating film described below, the $T_{P2}$ value is suitably such that $T_{P2}/T_{P3}$ is in the range of 1.1/1 to 20/1, preferably such that $T_{P2}/T_{P3}$ is in the range of 1.3/1 to 12/1, and more preferably such that $T_{P2}/T_{P3}$ is in the range of 1.5/1 to 8/1. By adjusting $T_{P2}$ and $T_{P3}$ in this manner it is possible to form a multilayer coating film with less unevenness of brightness and excellent sheen quality, in combination with the third pigmented coating film.

[Formation of Third Pigmented Coating Film]

In step (4), the third aqueous pigmented coating material (P3) as an aqueous coating material is applied onto the uncured second pigmented coating film obtained in step (3), to form a third pigmented coating film having a cured film thickness ($T_{P3}$) in the range of 1 to 10 μm. The third aqueous pigmented coating material (P3) contains a binder component ($A_{P3}$) and a light interference pigment (C), the coating material solid content being in the range of 5 to 20 mass %. $T_{P3}$ is adjusted in relation to the cured film thickness $T_{P2}$ of the second pigmented coating film, as mentioned above, so that $T_{P2}/T_{P3}$ is in the range of 1.1/1 to 20/1. By using the third aqueous pigmented coating material (P3) to form the third pigmented coating film, it is possible to form a high-lightness white multilayer coating film with excellent sheen quality, smoothness and weather resistance and reduced unevenness of whiteness, in combination with the first pigmented coating film and second pigmented coating film.

The binder component ($A_{P3}$) used in the third aqueous pigmented coating material (P3) may be appropriately selected among the base resins and crosslinking agents listed for description of the binder component to be used in the second aqueous pigmented coating material (P2).

The light interference pigment (C) is a brightness pigment having the surface of a flaky base material such as mica, artificial mica, glass, silica, iron oxide, aluminum oxide or metal, covered with a metal oxide such as titanium dioxide or iron oxide, which has a different refractive index from the base material. More specifically, examples include metal oxide-covered mica pigments, metal oxide-covered alumina flake pigments, metal oxide-covered glass flake pigments and metal oxide-covered silica flake pigments, as indicated below.

Metal oxide-covered mica pigments are pigments having natural mica or artificial mica as the base material, with the base material surface covered by a metal oxide. Natural mica is a flaky base material composed of ground mica ore, while artificial mica is synthesized by heating an industrial raw material such as $SiO_2$, MgO, $Al_2O_3$, $K_2SiF_6$ or $Na_2SiF_6$, melting at a high temperature of about 1500° C. and cooling to crystallization, and has fewer impurities than natural mica, while also having uniform size and thickness. Specific types that are known include fluorine phlogopite ($KMg_3ASi_3O_{10}F_2$), potassium tetrasilicon mica ($KMg_{25}ASi_4O_{10}F_2$), sodium tetrasilicon mica ($NaMg_{25}AlSi_4O_{10}F_2$), Na tainiolite ($NaMg_2LiSi_4O_{10}F_2$) and LiNa tainiolite ($LiMg_2LiSi_4O_{10}F_2$). Covering metal oxides include titanium oxide and iron oxide. Varying the covering thickness allows an interference color to be expressed.

Commercial products may be used as metal oxide-covered mica pigments. Examples of commercial metal oxide-covered mica pigment products include the "TWINCLE PEARL" Series by Nihon Koken Kogyo Co., Ltd., the "Lumina" Series and "Magna Pearl" Series by BASF Corp., and the "IRIODIN" Series by Merck Corp.

A metal oxide-covered alumina flake pigment is a pigment having an alumina flake base and having the base material surface covered with a metal oxide. The term "alumina flakes" means flaky (scaly) aluminum oxide. The aluminum oxide does not need to be the only component, as other metal oxides may also be included. Covering metal oxides include titanium oxide and iron oxide. Varying the covering thickness allows an interference color to be expressed.

Commercial products may be used as metal oxide-covered alumina flake pigments. Examples of commercial metal oxide-covered alumina flake pigment products include the "Xirallic" Series by Merck Corp.

A metal oxide-covered glass flake pigment comprises a scaly glass base material covered with a metal oxide, and since the base material surface is smooth, it exhibits a particle-like feel by strongly reflecting light rays. The metal oxide to be used for covering is not particularly restricted and may be a known compound such as titanium oxide or iron oxide.

Commercial products may be used as metal oxide-covered glass flake pigments. Examples of commercial metal oxide-covered glass flake pigment products include the "METASHINE" series by Nippon Sheet Glass Co., Ltd.

A metal oxide-covered silica flake pigment has flaky silica as a base material with a smooth surface and uniform thickness, covered by a metal oxide having a different refractive index from the base material.

Commercial products may be used as metal oxide-covered silica flake pigments. Examples of commercial metal oxide-covered silica flake pigment products include the "Colorstream" Series by Merck Corp.

The light interference pigment (C) may be surface-treated to improve the dispersibility or water resistance, chemical resistance and weather resistance.

The size of the light interference pigment (C) used is preferably a mean particle diameter in the range of 5 to 50 μm, and more preferably a mean particle diameter in the range of 7 to 35 m, from the viewpoint of exhibiting the finished appearance and interference color of the applied coating film. Also preferably, the thickness is in the range of 0.05 to 7.0 μm. The mean particle diameter referred to here is the median diameter in the volume-based particle size distribution, as measured by the laser diffraction scattering method using an MT3300 Microtrac particle size distribution analyzer (trade name of Nikkiso Co., Ltd.). The thickness is determined by observing a cross-section of the coating film containing the light interference pigment (C) using a microscope and measuring it with image processing software, defining the thickness to be the average value for 100 or more measured values.

The content ratio of the binder component ($A_{P3}$) and light interference pigment (C) in the third aqueous pigmented coating material (P3) is preferably in the range of 20 to 70 parts by mass, more preferably in the range of 25 to 60 parts by mass and even more preferably in the range of 28 to 50 parts by mass of the light interference pigment (C), based on 100 parts by mass as the solid content of the binder component ($A_{P3}$), from the viewpoint of the sheen quality of the white multilayer coating film that is formed.

The third aqueous pigmented coating material (P3) may further contain, as necessary, various coating material additives such as thickening agents, curing catalysts, ultraviolet absorbers, light stabilizers, antifoaming agents, plasticizers, surface control agents and anti-settling agents.

The third aqueous pigmented coating material (P3) may be applied by a known coating method such as electrostatic coating, air spraying or airless spraying.

The solid content of the third aqueous pigmented coating material (P3) is suitably in the range of 5 to 20 mass %, preferably in the range of 7 to 18 mass % and more preferably in the range of 9 to 15 mass %.

The thickness of the third pigmented coating film formed by the third aqueous pigmented coating material (P3) is suitably in the range of 1 to 10 μm, preferably in the range of 1.5 to 7.5 m and more preferably in the range of 2 to 6 μm, as the cured film thickness ($T_{P3}$). $T_{P3}$ is adjusted in relation to the cured film thickness $T_{P2}$ of the second pigmented coating film, as mentioned above, so that $T_{P2}/T_{P3}$ is in the range of 1.1/1 to 20/1.

By adjusting the solid content of the third aqueous pigmented coating material (P3) to within the aforementioned range while also adjusting the thickness of the third pigmented coating film formed by the third aqueous pigmented coating material (P3) to within a specific range and adjusting the thickness to a specific relationship with the film thickness of the second pigmented coating film, it is possible to obtain a coating film having reduced brightness unevenness and excellent sheen quality.

[Formation of Clear Coating Film]

According to the invention, a clear coating material (P4) is applied onto the uncured third pigmented coating film formed in step (4), to form a clear coating film (step (5)).

The clear coating material (P4) used may be a known one that is commonly used for coating of automobile bodies, and specific examples include organic solvent-based thermosetting coating materials, aqueous thermosetting coating materials and thermosetting powder coating materials comprising, as vehicle components, base resins such as acrylic resins, polyester resins, alkyd resins, urethane resins, epoxy resins and fluorine resins, that have crosslinkable functional groups such as hydroxyl groups, carboxyl groups, epoxy groups or silanol groups, and crosslinking agents such as melamine resins, urea resins, non-blocked polyisocyanate compounds, carboxyl group-containing compounds or resins and epoxy group-containing compounds or resins. Preferred among these are organic solvent-based thermosetting coating materials comprising a carboxyl group-containing resin and an epoxy group-containing resin, or thermosetting coating materials comprising a hydroxyl group-containing acrylic resin and an optionally blocked polyisocyanate compound. The clear coating material may be a one-pack type coating material, or a two-pack coating material such as a two-pack urethane resin coating material.

The clear coating material (P4) may also contain, as necessary, color pigments, brightness pigments, dyes, flatting agents and the like in ranges that do not impair the transparency, and may further contain, as suitable, extender pigments, ultraviolet absorbers, light stabilizers, antifoaming agents, thickening agents, rust-preventive agents, surface control agents and the like.

The clear coating material (P4) may be coated by a known method such as airless spraying, air spraying, rotary atomizing coating or the like, and electrostatic application may be carried out during the coating.

The clear coating material (P4) may usually be applied to a cured film thickness in the range of 10 to 80 μm, preferably 15 to 60 μm and more preferably 20 to 50 μm. From the viewpoint of preventing generation of coating defects, the applied clear coating material (P4) may be allowed to stand for an interval of about 1 to 60 minutes at room temperature, or preheated at a temperature of about 40° C. to about 80° C. for about 1 to 60 minutes, as necessary.

[Heat Curing of Coating Film]

In step (6), the multilayer coating film comprising the second pigmented coating film, third pigmented coating film and clear coating film formed in steps (3) to (5) is heated to cure the multilayer coating film all at once.

When the first pigmented coating film is not heat cured after application of the first pigmented coating material (P1) in step (2), the first pigmented coating film, second pigmented coating film, third pigmented coating film and clear coating film formed in steps (2) to (5) can be heated in step (6) to cure the multilayer coating film comprising the four coating films all at once. This allows one heat curing operation to be eliminated, so that energy efficiency can be further improved.

The heating means may be hot air heating, infrared heating or high-frequency heating, for example. The heating temperature is preferably 80 to 160° C. and more preferably 100 to 140° C. The heating time is preferably 10 to 60 minutes and more preferably 15 to 40 minutes. If necessary, the heat curing may be preceded by direct or indirect heating, via preheating or air blowing before heat curing, at a temperature of about 50° C. to about 110° C. and preferably about 60° C. to about 90° C., for about 1 to 60 minutes.

[Multilayer Coating Film after Formation]

The multilayer coating film formed by the steps described above has a layered structure comprising 4 layers: the first pigmented coating film, second pigmented coating film, third pigmented coating film and clear coating film, formed on the cured electrodeposition coating film. The method of the invention forms the first pigmented coating film, second pigmented coating film and third pigmented coating film each with a specific composition, lightness and film thickness using the specific first pigmented coating material (P1), second aqueous pigmented coating material (P2) and third aqueous pigmented coating material (P3), respectively, and thus allows formation of a high-lightness white multilayer coating film with excellent sheen quality, smoothness and weather resistance, and also reduced unevenness of whiteness.

EXAMPLES

The present invention will now be explained in greater detail using production examples, examples and comparative examples. However, the invention is in no way limited by the examples. Throughout the examples, the "parts" and "%" values are based on mass, unless otherwise specified. The film thicknesses of the coating films are based on the cured coating films.

Production of First Pigmented Coating Material (P1)

Production Example 1: Production of Hydroxyl Group-Containing Polyester Resin Into a reactor equipped with a thermometer, thermostat, stirrer, reflux condenser and water separator there were charged 174 parts of trimethylolpropane, 327 parts of neopentyl glycol, 352 parts of adipic acid, 109 parts of isophthalic acid and 101 parts of 1,2-cyclohexanedicarboxylic anhydride, and after heating from 160° C. to 230° C. over a period of 3 hours, the condensation water produced was distilled off with a water separator while maintaining a temperature of 230° C., and reaction was conducted until the acid value fell below 3 mgKOH/g. To this reaction product there was added 59 parts of trimellitic anhydride, and after addition reaction at 170° C. for 30 minutes, it was cooled to below 50° C., 2-(dimethylamino)ethanol was added in an amount equivalent to the acid groups for neutralization, and then deionized water was slowly added to obtain a hydroxyl group-containing polyester resin solution (PE-1) with a solid concentration of 45% and at pH 7.2. The obtained hydroxyl group-containing polyester resin had an acid value of 35 mgKOH/g, a hydroxyl value of 128 mgKOH/g and a weight-average molecular weight of 13,000.

Production Example 2: Production of Hydroxyl Group-Containing Acrylic Resin

Into a reactor equipped with a thermometer, thermostat, stirrer, reflux condenser, nitrogen gas inlet tube and dropper there was charged 35 parts of propyleneglycol monopropyl ether, and then after raising the temperature to 85° C., a mixture of 30 parts of methyl methacrylate, 20 parts of 2-ethylhexyl acrylate, 29 parts of n-butyl acrylate, 15 parts of 2-hydroxyethyl acrylate, 6 parts of acrylic acid, 15 parts of propyleneglycol monopropyl ether and 2.3 parts of 2,2'-azobis(2,4-dimethylvaleronitrile) was added dropwise over a period of 4 hours, upon completion of which the mixture was aged for 1 hour. Next, a mixture of 10 parts of propyleneglycol monopropyl ether and 1 part of 2,2'-azobis (2,4-dimethylvaleronitrile) was further added dropwise into a flask over a period of 1 hour, and upon completion of the dropwise addition the mixture was aged for 1 hour. Next, 7.4 parts of diethanolamine and 13 parts of propyleneglycol monopropyl ether were added to obtain a hydroxyl group-containing acrylic resin solution (AC-1) with a solid content of 55%. The obtained hydroxyl group-containing acrylic resin had an acid value of 47 mgKOH/g and a hydroxyl value of 72 mgKOH/g.

Production Example 3: Production of Titanium Dioxide Pigment (B) Dispersion

After placing 56 parts of the hydroxyl group-containing polyester resin solution (PE-1) obtained in Production Example 1 (solid content: 25 parts), 90 parts of "JR-806" (trade name of Tayca Corp., rutile titanium dioxide) and 5 parts of deionized water in a stirring and mixing container, 2-(dimethylamino)ethanol was further added and the pH was adjusted to 8.0. The obtained liquid mixture was placed in a wide-mouth glass bottle, glass beads of approximately 1.3 mmφ diameter were added as a dispersion medium, the bottle was sealed, and the mixture was dispersed for 30 minutes with a paint shaker to obtain a titanium dioxide pigment (B) dispersion (X-1).

Production Example 4: Production of Black Pigment Dispersion

After mixing 18 parts of the acrylic resin solution (AC-1) obtained in Production Example 2 (10 parts solid resin content), 10 parts of "Carbon MA-100" (trade name of Mitsubishi Chemical Corp., carbon black pigment) and 60 parts of deionized water, the mixture was adjusted to pH 8.2 with 2-(dimethylamino)ethanol, and then dispersed for 30 minutes with a paint shaker to obtain black pigment dispersion (X-2).

Production Example 5: Production of Extender Pigment Dispersion

After mixing 18 parts of the acrylic resin solution (AC-1) obtained in Production Example 2 (10 parts solid resin content), 25 parts of "BARIFINE BF-20" (trade name of Sakai Chemical Industry Co., Ltd., barium sulfate pigment), 0.6 part of "SURFYNOL 104A" (trade name of Air Products & Chemicals, antifoaming agent, 50% solid content) (0.3 part solid content) and 36 parts of deionized water, the mixture was dispersed for 1 hour with a paint shaker to obtain extender pigment dispersion (X-3).

Production of Aqueous First Pigmented Coating Material

Production Example 6

There were uniformly mixed 7.9 parts of the hydroxyl group-containing polyester resin solution (PE-1) obtained in Production Example 1 (solid resin content: 5.6 parts), 23.1 parts of the hydroxyl group-containing acrylic resin solution (AC-1) obtained in Production Example 2 (solid resin content: 12.7 parts), 42.9 parts of "UCOAT UX-8100" (trade name of Sanyo Chemical Industries, Ltd., urethane emulsion, solid content: 35%) (solid resin content: 15 parts), 37.5 parts of "CYMEL 325" (trade name of Allnex Co., melamine resin, solid content: 80%) (solid resin content: 30 parts), 26.3 parts of "BAYHYDUR VPLS2310" (trade name of Sumika Bayer Urethane Co., Ltd., blocked polyisocyanate compound, solid content: 38%) (solid resin content: 10 parts), 147.2 parts of the titanium dioxide pigment (B) dispersion (X-1) obtained in Production Example 3, 0.62 part of the black pigment dispersion (X-2) obtained in Production Example 4, and 17.6 parts of the extender pigment dispersion (X-3) obtained in Production Example 5. To the obtained mixture there were then added "PRIMAL ASE-60" (trade name of The Dow Chemical Company, thickening agent), 2-(dimethylamino)ethanol and deionized water, to obtain an aqueous first pigmented coating material (P1-1) having pH 8.0, a coating material solid content of 48%, and a viscosity of 30 seconds with a Ford cup No. 4 at 20° C.

Production Examples 7 to 10

Aqueous first pigmented coating materials (P1-2) to (P1-5) were obtained in the same manner as Production Example 6, except that the composition in Production Example 6 was as shown in Table 1. The lightness L* value ($L^*_{P1}$) of the cured coating film with a thickness of 30 m formed by each aqueous first base coating material, and the mean light transmittance ($TR_{P1}$) at a wavelength of 360 to 420 nm, are also shown in Table 1.

TABLE 1

| | | Production Example | | | | |
|---|---|---|---|---|---|---|
| | | 6 | 7 | 8 | 9 | 10 |
| First pigmented coating material (P1) name | | P1-1 | P1-2 | P1-3 | P1-4 | P1-5 |
| Hydroxyl-containing polyester resin (PE-1) solution | | 7.9 | 4.4 | 1.2 | 7.9 | 1.2 |
| Hydroxyl-containing acrylic resin (AC-1) solution | | 23.1 | 25.1 | 27.2 | 27.1 | 27.2 |
| UCOAT UX-8100 | | 42.9 | 42.9 | 42.9 | 42.9 | 42.9 |
| CYMEL 325 | | 37.5 | 37.5 | 37.5 | 37.5 | 37.5 |
| BAYHYDUR VPLS2310 | | 26.3 | 26.3 | 26.3 | 26.3 | 26.3 |
| Titanium dioxide pigment (B) dispersion (X-1) | | 147.2 | 162.3 | 175.6 | 147.2 | 175.6 |
| Black pigment dispersion (X-2) | | 0.62 | 0.53 | 0.44 | 0.79 | 0.18 |
| Extender pigment dispersion (X-3) | | 17.6 | 8.9 | 0.0 | 0.0 | 0.0 |
| Content [parts by mass] based on 100 parts by mass total solid content of binder component ($A_{P1}$) | Titanium dioxide pigment(B) | 88 | 97 | 105 | 88 | 105 |
| | Carbon black pigment | 0.07 | 0.06 | 0.05 | 0.09 | 0.02 |
| | Barium sulfate pigment | 5.5 | 2.8 | 0.0 | 0.0 | 0.0 |
| Coating material solid content [mass %] | | 48 | 48 | 48 | 48 | 48 |
| L* value ($L^*_{P1}$) with 30 μm cured film thickness | | 81 | 85 | 88 | 78 | 92 |
| Light transmittance ($TR_{P1}$) [%] at 360 to 420 nm with 30 μm film thickness | | 0.03 | 0.04 | 0.06 | 0.02 | 0.09 |

Production Example 11: Production of Hydroxyl Group-Containing Acrylic Resin

After charging 128 parts of deionized water and 3 parts of "ADEKA REASOAP SR-1025" (trade name of Adeka Corp., emulsifying agent, active ingredient: 25%) into a reactor equipped with a thermometer, thermostat, stirrer, reflux condenser, nitrogen gas inlet tube and dropper, the mixture was stirred under a nitrogen stream and heated to 80° C.

Next, 1% of the total core section monomer emulsion described below and 5.3 parts of a 6% ammonium persulfate aqueous solution were introduced into the reactor, and the mixture was kept at 80° C. for 15 minutes. The remainder of the core section monomer emulsion was then added dropwise into the reactor kept at the same temperature over a period of 3 hours, and upon completion of the dropwise addition the mixture was aged for 1 hour. Next, the shell section monomer emulsion was added dropwise over a period of 1 hour and aged for 1 hour, and the mixture was then cooled to 30° C. while gradually adding 40 parts of a 5% 2-(dimethylamino)ethanol aqueous solution to the reactor, and subsequently discharged while filtering with a 100 mesh nylon cloth, to obtain a water-dispersible hydroxyl group-containing acrylic resin (AC-2) aqueous dispersion with a mean particle diameter of 95 nm and a solid content of 30%. The obtained water-dispersible hydroxyl group-containing acrylic resin had an acid value of 33 mgKOH/g and a hydroxyl value of 25 mgKOH/g.

Core section monomer emulsion: 40 parts of deionized water, 2.8 parts of "ADEKA REASOAP SR-1025", 2.1 parts of methylenebisacrylamide, 2.8 parts of styrene, 16.1 parts of methyl methacrylate, 28 parts of ethyl acrylate and 21 parts of n-butyl acrylate were mixed and stirred to obtain a core section monomer emulsion.

Shell section monomer emulsion: 17 parts of deionized water, 1.2 parts of "ADEKA REASOAP SR-1025", 0.03 part of ammonium persulfate, 3 parts of styrene, 5.1 parts of 2-hydroxyethyl acrylate, 5.1 parts of methacrylic acid, 6 parts of methyl methacrylate, 1.8 parts of ethyl acrylate and 9 parts of n-butyl acrylate were mixed and stirred to obtain a shell section monomer emulsion.

Production Example 12: Production of Hydroxyl Group-Containing Polyester Resin

After charging 109 parts of trimethylolpropane, 141 parts of 1,6-hexanediol, 126 parts of 1,2-cyclohexanedicarboxylic anhydride and 120 parts of adipic acid into a reactor equipped with a thermometer, thermostat, stirrer, reflux condenser, nitrogen gas inlet tube and water separator, and heating from 160° C. to 230° C. for a period of 3 hours, condensation reaction was conducted at 230° C. for 4 hours. Next, 38.3 parts of trimellitic anhydride was added to introduce carboxyl groups into the obtained condensation reaction product, and reaction was conducted at 170° C. for 30 minutes, after which dilution was performed with 2-ethyl-1-hexanol to obtain a hydroxyl group-containing polyester resin solution (PE-2) with a solid content of 70%. The obtained hydroxyl group-containing polyester resin had an acid value of 46 mgKOH/g, a hydroxyl value of 150 mgKOH/g and a number-average molecular weight of 1,400.

Production of Second Aqueous Pigmented Coating Material (P2)

Production Example 13

After thoroughly mixing 100.0 parts of the water-dispersible hydroxyl group-containing acrylic resin (AC-2) aqueous dispersion obtained in Production Example 11 (solid content: 30 parts), 20.0 parts of the hydroxyl group-containing acrylic resin solution (AC-1) obtained in Production Example 2 (solid content: 11 parts), 6.0 parts of the polyester resin solution (PE-2) obtained in Production Example 12 (solid content: 4.2 parts), 37.5 parts of "CYMEL 325" (trade name of Allnex Co., melamine resin, solid content: 80%) (solid content: 30 parts), 125.5 parts of the titanium dioxide pigment (B) dispersion (X-1) obtained in Production Example 3 and 31.9 parts of the extender pigment dispersion (X-3) obtained in Production Example 5, there were further added "ADEKA NOL UH-756 VF" (trade name of Adeka Corp., thickening agent), 2-(dimethylamino)ethanol and deionized water, to obtain a second aqueous pigmented coating material (P2-1) having pH 8.0, a coating material solid content of 32%, and a viscosity of 40 seconds with a No. 4 Ford cup at 20° C.

Production Example 14 to 17

Second aqueous pigmented coating materials (P2-2) to (P2-5), with pH 8.0 and viscosity of 40 seconds using a Ford cup No. 4 at 20° C., were obtained in the same manner as Production Example 13, except for changing the formulating composition and coating material solid content for Production Example 13 as listed in Table 2 below.

TABLE 2

| | | Production Example | | | | |
|---|---|---|---|---|---|---|
| | | 13 | 14 | 15 | 16 | 17 |
| Second aqueous pigmented coating material (P2) name | | P2-1 | P2-2 | P2-3 | P2-4 | P2-5 |
| Water-dispersible hydroxyl group-containing acrylic resin (AC-2) aqueous dispersion | | 100.0 | 100.0 | 100.0 | 100.0 | 100.0 |
| Hydroxyl-containing acrylic resin (AC-1) solution | | 20.0 | 20.0 | 20.0 | 20.0 | 20.0 |
| Hydroxyl-containing polyester resin (PE-2) solution | | 6.0 | 0.0 | 6.0 | 6.0 | 6.0 |
| CYMEL 325 | | 37.5 | 37.5 | 37.5 | 37.5 | 37.5 |
| Titanium dioxide pigment (B) dispersion (X-1) | | 125.5 | 150.6 | 125.5 | 125.5 | 125.5 |
| Extender pigment dispersion (X-3) | | 31.9 | 31.9 | 31.9 | 31.9 | 31.9 |
| Content [parts by mass] based on 100 parts by mass total solid content of binder component ($A_{P2}$) | Titanium dioxide pigment(B) | 75 | 90 | 75 | 75 | 75 |
| | Barium sulfate pigment | 10 | 10 | 10 | 10 | 10 |
| Coating material solid content [mass %] | | 32 | 32 | 28 | 35 | 25 |

Production Example 18: Production of Hydroxyl Group- and Phosphate Group-Containing Acrylic Resin After placing a mixed solvent of 27.5 parts of methoxypropanol and 27.5 parts of isobutanol in a reactor equipped with a thermometer, thermostat, stirrer, reflux condenser, nitrogen inlet tube and dropper, and heating to 110° C., 121.5 parts of a mixture comprising 25.0 parts of styrene, 27.5 parts of n-butyl methacrylate, 20.0 parts of "Isostearyl acrylate" (trade name of Osaka Organic Chemical Industry, Ltd., branched higher alkyl acrylate), 7.5 parts of 4-hydroxybutyl acrylate, 15.0 parts of a phosphate group-containing polymerizable monomer, 12.5 parts of 2-methacryloyloxyethyl acid phosphate, 10.0 parts of isobutanol and 4.0 parts of t-butyl peroxyoctanoate was added to the mixed solvent over a period of 4 hours, and then a mixture of 0.5 part of t-butyl peroxyoctanoate and 20.0 parts of isopropanol was added dropwise over a period of 1 hour. The mixture was then stirred and aged for 1 hour to obtain an acrylic resin (AC-3) solution with hydroxyl and phosphate groups, having a solid content of 50%. The obtained acrylic resin (AC-3) with hydroxyl and phosphate groups had an acid value of 83 mgKOH/g, a hydroxyl value of 29 mgKOH/g and a weight-average molecular weight of 10,000.

Phosphate group-containing polymerizable monomer: After placing 57.5 parts of monobutylphosphoric acid and 41.0 parts of isobutanol in a reactor equipped with a thermometer, thermostat, stirrer, reflux condenser, nitrogen inlet tube and dropper and heating them to 90° C., 42.5 parts of glycidyl methacrylate was added dropwise over a period of 2 hours, and the mixture was further stirred and aged for 1 hour. Next, 59.0 parts of isopropanol was added to obtain a phosphate group-containing polymerizable monomer solution with a solid concentration of 50%. The acid value of the obtained monomer was 285 mgKOH/g.

Production of Light Interference Pigment Dispersion

Production Example 19

In a stirring and mixing container there were uniformly mixed 30 parts of "Xirallic T60-10 SW Crystal Silver" (trade name of Merck, Ltd., metal oxide-covered alumina flake pigment), 35 parts of 2-ethyl-1-hexanol and 18 parts of the hydroxyl group- and phosphate group-containing acrylic resin (AC-3) solution obtained in Production Example 18 (solid content: 9 parts), to obtain light interference pigment dispersion (X-4).

Production Example 20

In a stirring and mixing container there were uniformly mixed 35 parts of "Magnapearl Exterior CFS 1103" (trade name of BASF Corp., metal oxide-covered mica flake pigment), 35 parts of 2-ethyl-1-hexanol and 21 parts of the hydroxyl group- and phosphate group-containing acrylic resin (AC-3) solution obtained in Production Example 18 (solid content: 10.5 parts), to obtain light interference pigment dispersion (X-5).

Production of Third Aqueous Pigmented Coating Material (P3)

Production Example 21

After uniformly mixing 100.0 parts of the water-dispersible hydroxyl group-containing acrylic resin (AC-2) aqueous dispersion obtained in Production Example 11 (solid content: 30 parts), 20.0 parts of the hydroxyl group-containing acrylic resin solution (AC-1) obtained in Production Example 2 (solid content: 11 parts), 28.6 parts of the polyester resin solution (PE-2) obtained in Production Example 12 (solid content: 20 parts), 37.5 parts of "CYMEL 325" (trade name of Allnex Co., melamine resin, solid content: 80%) (solid content: 30 parts) and 83 parts of the light interference pigment dispersion (X-4) obtained in Production Example 19, there were further added "PRIMAL ASE-60" (trade name of The Dow Chemical Company, polyacrylic acid-based thickening agent), 2-(dimethylamino)ethanol and deionized water, to obtain a third aqueous pigmented coating material (P3-1) having a pH of 8.0, a coating material solid content of 14%, and a viscosity of 40 seconds using a Ford cup No. 4 at 20° C. The content of the light interference pigment (C) in the third aqueous pigmented coating material (P3-1) was 30 parts by mass, based on 100 parts by mass as the solid content of the binder component in the third aqueous pigmented coating material (P3-1).

Production Example 22 to 25

Third aqueous pigmented coating materials (P3-2) to (P3-5) with pH 8.0 and viscosity of 40 seconds using a Ford cup No. 4 at 20° C., were obtained in the same manner as Production Example 21, except for changing the formulating composition and coating material solid content for Production Example 21 as listed in Table 3 below.

TABLE 3

| | Production Example | | | | |
|---|---|---|---|---|---|
| | 21 | 22 | 23 | 24 | 25 |
| Third aqueous pigmented coating material (P3) name | P3-1 | P3-2 | P3-3 | P3-4 | P3-5 |
| Water-dispersible hydroxyl group-containing acrylic resin (AC-2) aqueous dispersion | 100 | 100 | 100 | 100 | 100 |
| Hydroxyl-containing acrylic resin (AC-1) solution | 20.0 | 20.0 | 20.0 | 17.3 | 20.0 |
| Hydroxyl-containing polyester resin (PE-2) solution | 28.6 | 28.6 | 28.6 | 28.6 | 28.6 |
| CYMEL 325 | 37.5 | 37.5 | 37.5 | 37.5 | 37.5 |
| Light interference pigment (C) dispersion (X-4) | 83 | 83 | 83 | | 83 |
| Light interference pigment (C) dispersion (X-5) | | | | 91 | |
| Light interference pigment (C) content [parts by mass] based on 100 parts by mass total solid content of binder component ($A_{P3}$) | 30 | 30 | 30 | 35 | 30 |
| Coating material solid content [mass %] | 14 | 16 | 9 | 14 | 25 |

Preparation of Test Object to be Coated

A zinc phosphate-treated cold-rolled steel sheet was electrodeposited with a thermosetting epoxy resin-based cation electrodeposition coating composition (trade name "ELECRON GT-10" by Kansai Paint Co., Ltd.) to a film thickness of 20 μm, and heated at 170° C. for 30 minutes for curing to produce a test object to be coated.

Example 1

Two test objects to be coated were coated with the first aqueous pigmented coating material (P1-1) obtained in Production Example 6 to a cured film thickness of 30 μm, using a rotary atomizing electrostatic coater, to form first pigmented coating films, and after allowing them to stand for 2 minutes, they were preheated at 80° C. for 3 minutes. Next, the second aqueous pigmented coating material (P2-1) obtained in Production Example 13 was coated onto each uncured first pigmented coating film to a cured film thickness of 12 μm using a rotary atomizing electrostatic coater, to form a second pigmented coating film.

One of the two test objects to be coated was then removed out and allowed to stand for 1 minute, and preheated at 80° C. for 3 minutes. It was then heated at 140° C. for 30 minutes, and the uncured first pigmented coating film and uncured second pigmented coating film were cured to obtain test coated plate A.

The other test object to be coated was allowed to stand for 1 minute after application of the second aqueous pigmented coating material (P2-1), after which the third aqueous pigmented coating material (P3-1) obtained in Production Example 21 was electrostatically coated onto the uncured second pigmented coating film using a rotary atomizing electrostatic coater, to a cured film thickness of 3 μm, to form a third pigmented coating film which was allowed to stand for 3 minutes. After preheating at 80° C. for 3 minutes, the uncured third pigmented coating film was electrostatically coated with a thermosetting acid/epoxy curable acrylic resin-based organic solvent clear coating material (trade name: "MAGICRON KINO-1210TW" by Kansai Paint Co., Ltd.), using a rotary atomizing electrostatic coater, to a cured film thickness of 35 μm to form a clear coating film. After standing for 7 minutes, it was heated at 140° C. for 30 minutes, and the uncured first pigmented coating film, the uncured second pigmented coating film, the uncured third pigmented coating film and the uncured clear coating film were cured to fabricate test coated plate B.

Examples 2 to 11, Comparative Examples 1 to 3

Test plates A and test plates B were prepared in the same manner as Example 1, except that the type of first aqueous pigmented coating material, second aqueous pigmented coating material and third aqueous pigmented coating material and the cured film thickness in Example 1 were as shown in Table 4-1 and Table 4-2 below.

Example 12

Two test objects to be coated were coated with the first aqueous pigmented coating material (P1-1) obtained in Production Example 6 to a cured film thickness of 30 μm, using a rotary atomizing electrostatic coater, to form first pigmented coating films, and after allowing them to stand for 2 minutes, they were preheated at 80° C. for 3 minutes. There were then heated at 140° C. for 30 minutes to cure the first pigmented coating film. Next, the second aqueous pigmented coating material (P2-1) obtained in Production Example 13 was coated onto each cured first pigmented coating film to a cured film thickness of 12 μm using a rotary atomizing electrostatic coater, to form a second pigmented coating film.

One of the two test objects to be coated was then removed out and allowed to stand for 1 minute, and preheated at 80° C. for 3 minutes. It was then heated at 140° C. for 30 minutes, and the uncured first pigmented coating film and uncured second pigmented coating film were cured to obtain test coated plate A.

The other test object to be coated was allowed to stand for 1 minute after coating of the second aqueous pigmented coating material (P2-1). Next, the third aqueous pigmented coating material (P3-1) obtained in Production Example 21 was coated onto each uncured second pigmented coating film to a cured film thickness of 3 μm using a rotary atomizing electrostatic coater, to form a third pigmented coating film, and was allowed to stand for 3 minutes. After preheating at 80° C. for 3 minutes, the uncured third pigmented coating film was electrostatically coated with a thermosetting acid/epoxy curable acrylic resin-based organic solvent clear coating material (trade name: "MAGICRON KINO-1210TW" by Kansai Paint Co., Ltd.), using a rotary atomizing electrostatic coater, to a cured film thickness of 35 μm to form a clear coating film. After standing for 7 minutes, it was heated at 140° C. for 30 minutes, and the uncured first pigmented coating film, the uncured second pigmented coating film, the uncured third pigmented coating film and the uncured clear coating film were cured to obtain test coated plate B.

Evaluation Test

Each test coated plate A and test coated plate B obtained in Examples 1 to 12 and Comparative Examples 1 to 3 were evaluated by the following test methods. The evaluation results are shown in Table 4-1 and Table 4-2.

TABLE 4-1

| | | | Example | | | | | | | |
|---|---|---|---|---|---|---|---|---|---|---|
| | | | 1 | 2 | 3 | 4 | 5 | 6 | 7 | 8 |
| Step (1) | Electrodeposition coating material | | ELECRON GT-10 | | | | | | | |
| Step (2) | First pigmented coating material (P1) | Coating material name | P1-1 | P1-2 | P1-3 | P1-2 | P1-2 | P1-2 | P1-3 | P1-2 |
| | | Coating material solid content [mass %] | 48 | 48 | 48 | 48 | 48 | 48 | 48 | 48 |
| | | L* value ($L^*_{P1}$) with 30 μm cured film thickness | 81 | 85 | 88 | 85 | 85 | 85 | 88 | 85 |
| | Curing of first pigmented coating film | | Not cured | Not cured | Not cured | Not cured | Not cured | Not cured | Not cured | Not cured |
| Step (3) | Second aqueous pigmented coating material (P2) | Coating material name | P2-1 | P2-1 | P2-1 | P2-1 | P2-1 | P2-1 | P2-1 | P2-2 |
| | | Coating material solid content [mass %] | 32 | 32 | 32 | 32 | 32 | 32 | 32 | 32 |
| | Cured film thickness ($T_{P2}$) [μm] | | 12 | 12 | 12 | 8 | 15 | 18 | 8 | 12 |
| Step (4) | Third aqueous pigmented coating material (P3) | Coating material name | P3-1 | P3-1 | P3-1 | P3-1 | P3-1 | P3-1 | P3-1 | P3-1 |
| | | Coating material solid content [mass %] | 14 | 14 | 14 | 14 | 14 | 14 | 14 | 14 |
| | Cured film thickness ($T_{P3}$) [μm] | | 3 | 3 | 3 | 3 | 3 | 3 | 3 | 3 |
| Step (5) | Clear coating material (P4) | | MAGICRON KINO-1210TW | | | | | | | |
| Step (6) | Heating temperature [° C.] | | 140 | 140 | 140 | 140 | 140 | 140 | 140 | 140 |
| | Heating time [min] | | 30 | 30 | 30 | 30 | 30 | 30 | 30 | 30 |

TABLE 4-1-continued

| | | Example | | | | | | | |
|---|---|---|---|---|---|---|---|---|---|
| | | 1 | 2 | 3 | 4 | 5 | 6 | 7 | 8 |
| Lightness L* value ($L^*_{P2}$) of second pigmented coating film when cured | | 86 | 90 | 93 | 88 | 92 | 94 | 91 | 92 |
| Difference between $L^*_{P2}$ and $L^*_{P1}$ | | 5 | 5 | 5 | 3 | 7 | 9 | 3 | 7 |
| Cured film thickness ratio $T_{P2}/T_{P3}$ | | 4/1 | 4/1 | 4/1 | 2.7/1 | 5/1 | 6/1 | 2.7/1 | 4/1 |
| Evaluation | Sheen quality | 118 | 122 | 125 | 120 | 124 | 126 | 123 | 124 |
| | Weather resistance | VG | VG | G | VG | VG | VG | G | VG |
| | Unevenness of whiteness | VG | VG | VG | G | VG | VG | VG | VG |
| | Smoothness | B | B | B | C | B | A | C | B |

TABLE 4-2

| | | | Example | | | | Comparative Example | | |
|---|---|---|---|---|---|---|---|---|---|
| | | | 9 | 10 | 11 | 12 | 1 | 2 | 3 |
| Step (1) | Electrodeposition coating material | | ELECRON GT-10 | | | | ELECRON GT-10 | | |
| Step (2) | First pigmented coating material (P1) | Coating material name | P1-2 | P1-2 | P1-2 | P1-3 | P1-4 | P1-5 | P1-2 |
| | | Coating material solid content [mass %] | 48 | 48 | 48 | 48 | 48 | 48 | 48 |
| | | L* value ($L^*_{P1}$) with 30 μm cured film thickness | 85 | 85 | 85 | 85 | 78 | 92 | 85 |
| | Curing of first pigmented coating film | | Not cured | Not cured | Not cured | Cured | Not cured | Not cured | Not cured |
| Step (3) | Second aqueous pigmented coating material (P2) | Coating material name | P2-3 | P2-4 | P2-1 | P2-1 | P2-1 | P2-1 | P2-5 |
| | | Coating material solid content [mass %] | 28 | 35 | 32 | 32 | 32 | 32 | 25 |
| | Cured film thickness ($T_{P2}$) [μm] | | 10 | 14 | 12 | 12 | 22 | 12 | 7.5 |
| Step (4) | Third aqueous pigmented coating material (P3) | Coating material name | P3-2 | P3-3 | P3-4 | P3-1 | P3-1 | P3-1 | P3-5 |
| | | Coating material solid content [mass %] | 16 | 9 | 14 | 14 | 14 | 14 | 25 |
| | Cured film thickness ($T_{P3}$) [μm] | | 4 | 3 | 3 | 3 | 3 | 3 | 7.5 |
| Step (5) | Clear coating material (P4) | | MAGICRON KINO-1210TW | | | | MAGICRON KINO 1210TW | | |
| Step (6) | Heating temperature [° C.] | | 140 | 140 | 140 | 140 | 140 | 140 | 140 |
| | Heating time [min] | | 30 | 30 | 30 | 30 | 30 | 30 | 30 |
| Lightness L* value ($L^*_{P2}$) of second pigmented coating film when cured | | | 90 | 90 | 90 | 90 | 90 | 95 | 90 |
| Difference between $L^*_{P2}$ and $L^*_{P1}$ | | | 5 | 5 | 5 | 5 | 12 | 3 | 5 |
| Cured film thickness ratio $T_{P2}/T_{P3}$ | | | 2.5/1 | 4.7/1 | 4/1 | 4/1 | 7.3/1 | 4/1 | 1/1 |
| Evaluation | Sheen quality | | 119 | 125 | 119 | 122 | 122 | 127 | 110 |
| | Weather resistance | | VG | VG | VG | VG | VG | P | VG |
| | Unevenness of whiteness | | VG | VG | VG | VG | VG | VG | F |
| | Smoothness | | B | B | B | B | D | B | C |

TEST METHODS

Lightness L* value ($L^*_{P2}$) of second aqueous pigmented coating material (P2) when cured: The L* value of the test coated plate A was measured. Specifically, a "CM-512m3" multi-angle spectrophotometer (product of Konica Minolta Holdings, Inc.) was used to irradiate the coating film surface with light from an angle of 45 with respect to the perpendicular axis, and the L* value of the reflected light in the direction perpendicular to the coating film surface was measured.

Sheen Quality: The L* value (L*15 value) of test coated plate B at an acceptance angle of 150 was measured using a multi-angle spectrophotometer (trade name, "MA-6811" by x-Rite). An L*15 value of ≥115 is considered to be acceptable.

The L* value (L*15 value) at an acceptance angle of 150 is, specifically, the L* value for light received at an angle of 15° in the direction of measuring light from the specular reflection angle, when measuring light has been irradiated from an angle of 45 with respect to the axis perpendicular to the measuring surface.

Weather resistance: The test coated plate B was subjected to an accelerated weather resistance test according to JIS K 5600-7-7, using a "SUPER XENON WEATHER METER" (weather resistance tester by Suga Test Instruments Co., Ltd.) under conditions with a test piece wetting cycle of 18 minutes/2 hrs and a black panel temperature of 61 to 65° C. When the lamp exposure time reached 2,000 hours, the multilayer coating film of the test plate was cut in a lattice-like manner down to the base material using a cutter, creating a grid with 100 squares of size 2 mm×2 mm. Adhesive cellophane tape was then attached to the surface and the tape was abruptly peeled off, after which the residual state of the square grid coating film was examined.

VG: 100 of the square grid coating films remained, with no minute edge chipping of the coating films at the edges of the cut notches.

G: 100 of the square grid coating films remained, but minute edge chipping of the coating films occurred at the edges of the cut notches.

F: 90-99 of the square grid coating films remained.

P: 89 or fewer of the square grids of the coating film remained.

Unevenness of whiteness: The test coated plate B was observed with the naked eye and the degree of unevenness of whiteness was evaluated on the following scale.

VG: Virtually no unevenness of whiteness found, very excellent outer appearance of coating film, G: Slight unevenness of whiteness found, but excellent outer appearance of coating film, F: Unevenness of whiteness found, somewhat inferior outer appearance of coating film, P: Considerable unevenness of whiteness found, inferior outer appearance of coating film.

Smoothness: For test coated plate B, evaluation was conducted using the Wd value measured with a "Wave Scan DOI" (trade name of BYK Gardner). The Wd value is an index of the amplitude of surface roughness with a wavelength of about 3 to 10 mm, with a smaller measured value representing higher smoothness of the coating surface.

A: Wd value of ≤5.

B: Wd value of >5 and ≤10.

C: Wd value of >10 and ≤15.

D: Wd value of >15 and ≤30.

E: Wd value of >30.

The invention claimed is:

1. A multilayer coating film-forming method comprising the following steps (1) to (6):

(1) applying an electrodeposition coating material onto a steel sheet and heat curing it to form a cured electrodeposition coating film, (2) applying a first pigmented coating material (P1) onto the cured electrodeposition coating film obtained in step (1) to form a first pigmented coating film, the first pigmented coating material (P1) having a lightness L* value ($L^*_{P1}$) in the range of 80 to 89 if the first pigmented coating film is formed to a thickness of 30 μm, (3) applying a second aqueous pigmented coating material (P2) comprising a binder component ($A_{P2}$) and a titanium dioxide pigment (B) and having a coating material solid content in the range of 21 to 50 mass % onto the first pigmented coating film obtained in step (2), to form a second pigmented coating film having a cured film thickness ($T_{P2}$) in the range of 5 to 20 μm and a lightness L* value ($L^*_{P2}$) when cured, in the range of 85 to 95, (4) applying a third aqueous pigmented coating material (P3) onto the second pigmented coating film obtained in step (3) to form a third pigmented coating film having a cured film thickness ($T_{P3}$) in the range of 1 to 10 μm, the third aqueous pigmented coating material (P3) comprising a binder component ($A_{P3}$) and a light interference pigment (C) and having a coating material solid content in the range of 5 to 20 mass %, (5) applying a clear coating material (P4) onto the third pigmented coating film obtained in step (4) to form a clear coating film, and (6) heating the multilayer coating film including the second pigmented coating film, the third pigmented coating film and the clear coating film formed in steps (3) to (5), to simultaneously cure the multilayer coating film, wherein $L^*_{P2}$ is higher than $L^*_{P1}$, the difference between $L^*_{P2}$ and $L^*_{P1}$ is in the range of 1 to 10, and the ratio of $T_{P2}$ and $T_{P3}$ is in the range of $T_{P2}/T_{P3}$=1.1/1 to 20/1.

2. The multilayer coating film-forming method according to claim 1, wherein the first pigmented coating material (P1) is an aqueous coating material.

3. The multilayer coating film-forming method according to claim 1, wherein the first pigmented coating film when cured has a film thickness ($T_{P1}$) in the range of 15 to 40 μm.

4. The multilayer coating film-forming method according to claim 1, wherein the content ratio of the binder component ($A_{P2}$) and the titanium dioxide pigment (B) in the second aqueous pigmented coating material (P2) is in the range of 60 to 150 parts by mass of the titanium dioxide pigment (B) with respect to 100 parts by mass as the solid content of the binder component ($A_{P2}$).

5. The multilayer coating film-forming method according to claim 1, wherein the content ratio of the binder component ($A_{P3}$) and the light interference pigment (C) in the third aqueous pigmented coating material (P3) is in the range of 20 to 70 parts by mass of the light interference pigment (C) with respect to 100 parts by mass as the solid content of the binder component ($A_{P3}$).

6. The multilayer coating film-forming method according to claim 1, wherein the mean light transmittance ($TR_{P1}$) of a 30 μm-thick cured coating film obtained by application and curing of the first pigmented coating material (P1), at a wavelength of 360 to 420 nm, is in the range of 0.08% or lower.

7. The multilayer coating film-forming method according to claim 1, wherein the second aqueous pigmented coating material (P2) is applied onto the first pigmented coating film.

8. The multilayer coating film-forming method according to claim 1, wherein the second aqueous pigmented coating material (P2) is applied onto the uncured first pigmented coating film, and the first pigmented coating film, second pigmented coating film, third pigmented coating film and clear coating film formed in steps (2) to (5) are heated in step (6) to cure the multilayer coating film comprising the four coating films all at once.

* * * * *